United States Patent [19]

Ritter

[11] 4,011,676

[45] Mar. 15, 1977

[54] PERSONALIZED MESSAGE SYSTEM AND PROCESS

[76] Inventor: Frederick J. Ritter, 6007 N. Sheridan Road, Chicago, Ill. 60660

[22] Filed: Jan. 8, 1975

[21] Appl. No.: 539,290

[52] U.S. Cl. ..... 40/143; 40/125 E; 40/130 E; 40/133 B

[51] Int. Cl.[2] ..... G09F 7/06

[58] Field of Search ..... 40/143, 125 E, 133 B, 40/28 C, 130 E

[56] References Cited

UNITED STATES PATENTS

| | | | |
|---|---|---|---|
| 1,089,996 | 3/1914 | Walker | 40/125 E |
| 2,759,295 | 8/1956 | Keuls | 40/143 X |
| 3,076,890 | 2/1963 | Guth | 40/143 X |

FOREIGN PATENTS OR APPLICATIONS

| | | | |
|---|---|---|---|
| 666,860 | 5/1929 | France | 40/143 |
| 269,949 | 8/1927 | United Kingdom | 40/143 |

*Primary Examiner*—John F. Pitrelli
*Attorney, Agent, or Firm*—Alter and Weiss

[57] ABSTRACT

A personalized message apparatus comprises a plate which has a cellular structure for providing fastening connector halves or holes. Integral with and covering the cellular structure is a surface which can be punched out in selected cells. The indicia comprises letters, numbers, fractions of letters or numbers, or other configurations or designs, each of which includes mating fastening connectors which fit through the punched surface into the holes. The indicia are placed over the surface and the connectors are pressed or snapped into the mating holes of the cellular structure. The plate, even without individual letters, numbers, fractions of these or the like, can be used for indicia by merely punching out or opening up holes in the proper arrangement to give the configuration of letters, figures, or any other shape or form.

2 Claims, 27 Drawing Figures

PERSONALIZED MESSAGE SYSTEM AND PROCESS

This invention relates to descriptive, designating, and decorative indicia and more particularly, to means for personalizing manufactured articles or products.

As used herein, the term "indicia" is intended to cover almost any graphical device such as trademarks, letters, numbers, strips, cartoons, designs or any combination thereof. The term "indicia" refers especially — although not exclusively — to personalized devices, such as initials, names, greetings, or the like. Therefore, a particular advantage is realized where a well-known trademark can be personalized, as for example, "Built by S , especially for R. G." where "S " indicates any manufacturer and "R. G." are the initials of the buyer.

The term "indicia" is also intended to take into account the background of the display. For example, the name or slogan can be set against the background of edge lit transparent material or of any suitable color or design. Or, it could be set against a padded leather-like surface, a simulated wood grain, a sintered metallic appearance, or the like.

The indicia is used with a device to display a "message" (such as names, numbers, lines, drawings, images, messages, notes) either on flat boards, or on the visible surfaces of housings of any of various products. The display may give information, instruction, or may personalize the product itself.

Heretofore, efforts to make such personalized products have not met with great success. The prior art has tended to provide letters or numbers against a peg board background or perforations, slots, grooves, hangers or the like, which have the display an extremely utilitarian appearance.

Thus, an object of the invention is to provide new and improved personalized products. Here, an object is to provide such indicia with a distinctively decorative background or with a plain background concealing any fasteners. An object also is to provide either a distinctive background or a background which is indistinguishable from the product itself without revealing the underlying cellular structure.

Another object of the invention is to provide a new and improved process for making personalized products. In particular, an object is to provide a process which is equally applicable to a wide range of products, and also to signs, name tags, number plates and the like.

In keeping with an aspect of the invention, these and other objects are achieved by an apparatus comprising a surface covering indentations or other structures forming a plurality of fastening connector halves arranged in a cellular structure. The indicia comprises letters, numbers, or the like which include mating fastening connectors. The surface is punched in selected areas and then the indicia are pressed or otherwise fastened into place. The connector or connectors on the indicia enter the punched area and each one attaches itself to the connector half in a single cell of the cellular structure.

The nature of preferred embodiments of the invention will become more apparent from a study of the attached drawings wherein:

FIGS. 1A and 1B are perspective view partly cut away of a first and preferred embodiment of an inventive structure which may be used for making tags, signs, or the like;

Figure 1A:
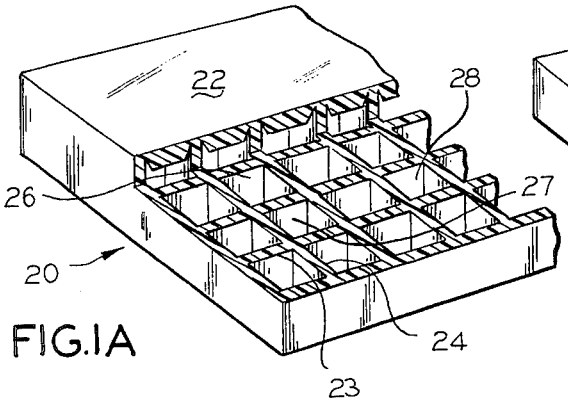
Figure 1B:
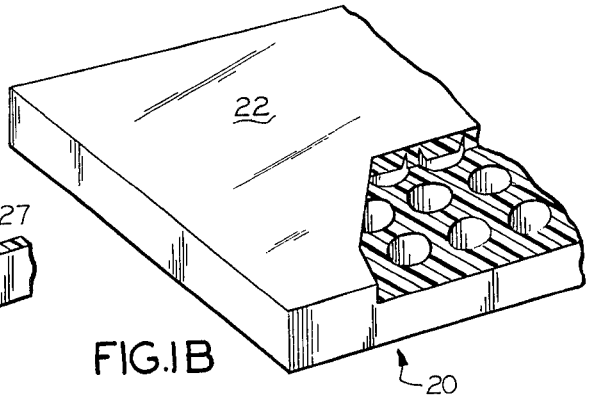

The inventive boards are structures made or composed of one or more sheets of plastics, metals, wood, glass, ceramic or other materials, shaped into various forms and sizes. More particularly, the preferred embodiment structure of FIG. 1 includes an integral structure 20, comprising a cellular arrangement having a surface 22 which may be either smooth or textured. The cellular structure 20 is shown in FIG. 1A as comprising a grid of horizontal and vertical members; an exemplary two of which are identified at 23, 24 respectively. The spaces between these partitions form rows and columns of first fastening connector halves. By way of example, three of these connector halves are in cells at 26, 27, 28. FIG. 1B shows a similar structure having a grid of circular holes for providing connector halves. Any conveniently shaped holes may be used.

The exact nature of the connector halves in the cells 26, 27, 28 is irrelevant to the invention. Any suitable device may be used. For example, internal fins (not shown) may be formed to spread apart within each cell hole and to enable a rod to be pushed therethrough but not withdrawn therefrom. As here shown, there is merely an interference fit between the walls of the cell hole and a rod-like member pushed into the hole.

There is no reason why the cellular pattern must be uniform throughout the whole board area or why both vertical and horizontal partitions must be provided. However, the pattern shown in FIG. 1A is preferred since it enables both vertical and horizontal alignment. For example, the connector in cell 26 is vertically aligned in a column above the connector in cell 27, which in turn, in horizontally aligned in the row beside the connector in cell 28. Thus, the application of any indicia to the device automatically produces both vertical and horizontal alignment.

While FIG. 1A shows square holes formed by the cellular structure, this shape is irrelevant. Any suitable shape (such as round, hexagonal, triangular, or the like) of hole may be used. This is symbolically shown by circular holes in FIG. 1B.

The surface 22 that covers the cellular structure is smooth or textured with little or no telltale shrinkage or wrinkles which disclose the underlying cellular structure. More particularly, when the display areas of the products and of the boards are prepared for fastening or showing the message elements, there is nothing of significance to indicate where the indicia should be located. In various embodiments, the surface 22 may have wood grain, leather, or a similar appearance. The surface 22 may also be metallized or covered by a plastic sheet or by a foil, while the cellular structure 20 may be a light conductive or a light transmitting material. It may also be edge lit.

Figure 2A:
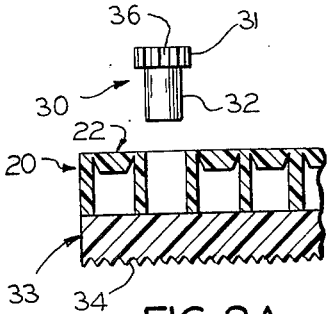
FIG. 2 is an exploded cross-sectional view showing two reflector systems and taken along line 2—2 of FIG. 1.
Figure 2B:
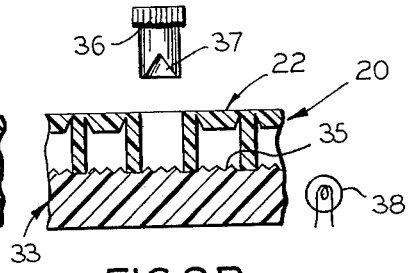

As seen in FIGS. 2 and 3, an indicia device 30 may be a light transmitting head 31 with an integral rod 32 attached thereto. Accordingly, assuming any adequate light source, any wall color behind board 20 will show through the indicia 30. Therefore, the coloration of the structure inherently blends in with almost any existing color scheme. Also, an edge lit plastic sheet 33 (FIGS. 2A, 2B) may cover the back of the board, so that light will shine through the rod 32 and head 31. If desired, a reflector surface 34 which may be mirror coated by any suitable process or a lens 35 may be used. The head 31 may also have a lens system 36 formed thereon, in order to spread the light over a wider angle. Lens system 36 may include a rippled surface, preferably inside the indicia, to improve the reflective properties. Likewise, the base of the rod 32 may have a lens 37 formed therein to collect color or light from the background. Bulb 38 symbolically shows means for edge lighting the plastic sheet 33.

According to the invention, the indicia 30 may be positioned over the surface 22 and then pushed through a hole formed therein, so that rod 32 passes into the hole with an interference fit. The hole is prepunched through the surface 22 in any suitable manner, as by means of a pencil tip, a screwdriver or the like. After the indicia 30 is in place, it seizes upon the connector in the cell and cannot thereafter be easily pulled from the hole.

In greater detail, the cellular structure of the board 20, of the FIG. 1 embodiment may be constructed in any suitable manner. In order to understand the underlying principles, references may be made to FIG. 3 which illustrates many of the considerations involved.

Figure 3A:
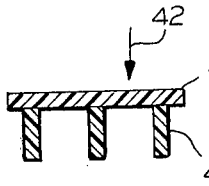
FIG. 3 is a series of cross-sectional and plan view, similar to FIG. 2 for schematically showing various cellular structures.
Figure 3B:
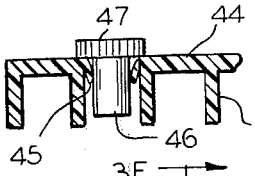

In FIG. 3A, the cellular structure 40 is a grid of dividers having a thin sheet 41 cemented or otherwise attached thereto. The sheet 41 is punched by a force, as at 42 in order to insert an indicia. In FIG. 3B, the structure is the same except that cellular structure 43 and surface 44 are an integral device. The structure functions well except that the surface 42 tends to rupture and to leave torn tabs 45. If the post 46 on indicia 47 is pressed into the resulting hole, these torn tabs act as shims to help secure the indicia in place.

Sometimes, the tabs formed by tearing surface 41, 44 are objectionable, and it is desirable to have a cleaner break, when the holes are punched through the surface. Accordingly, the cellular structure is formed to have a thin fracture line (as at 48, FIGS. 3C and 3D) to surround the hole. This fracture line may be further modified by other fracture lines intersecting the island of material 49 inside the hole. For example, FIGS. 3E and 3F are cross sectional and plan view of islands 49A intersected with a fracture line in an x-form. The thickened portion of island 49 lends a greater strength so that the fracture is confined to the fracture lines, thereby insuring a cleaner break. FIG. 3G shows similar fracture lines for when the cellular structure has round holes, as in FIG. 1B.

Figure 3C:
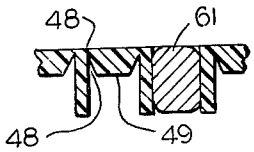
Figure 3D:
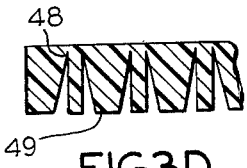
Figure 3E:
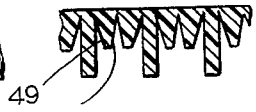
Figure 3F:
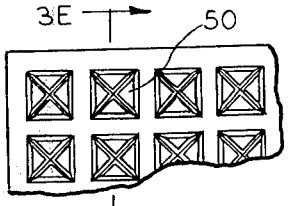
Figure 3G:
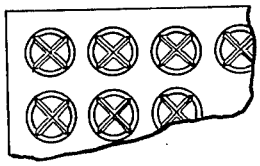
Figure 3H:
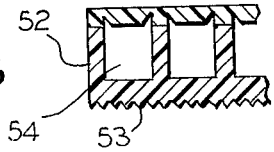

The structure of FIGS. 3C and 3D are essentially the same. Sometimes it is easier to mold a sheet of plastic with a uniform thickness throughout (FIG. 3D) and sometimes the uniformity of thickness is irrelevant in which case a small savings of material is preferred (as in FIG. 3C). Also, for economic reasons it might be advantageous to form a sheet of uniform thickness and to partially punch out the island (as in FIG. 3D). The structure of FIG. 3H is a further refinement of the structure of FIG. 3C. Here, a clear plastic sheet 52 having a reflector surface 53 (or perhaps a lenticular lens) is attached to the back of the structure of FIG. 3D in order to provide back lighting. Since a relief space must be provided to receive the punched out plug 49, the sheet 52 contains a relieved area 54 under each plug area 49.

Figure 4A:
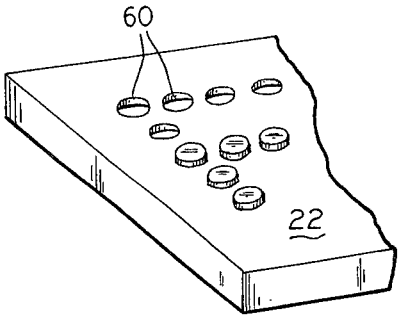
FIG. 4 is all three perspective views of the structure of FIG. 3, with mosaic indicia.
Figure 4B:
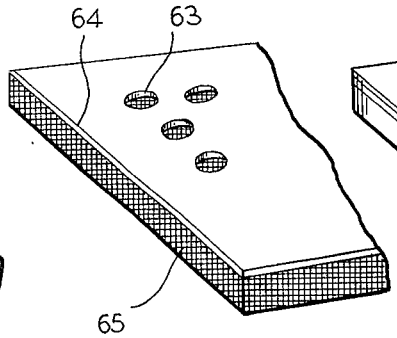

FIG. 4 illustrates how the described process may be used to make the preferred embodiment of a display board for personalized indicia, whereby a mosaic is assembled by pushing successive holes 60 through surface 22 in order to form a series of openings in any alpha-numerical or other pattern. The board of FIG. 4 may simply be placed against a wall or sheet which may be seen through the punched holes. Or a series indicia device 30 may be pushed through each of the holes 40 to form a mosaic. In some cases, a simple dot may be used in the surface 22 (as shown at 61, FIG. 3C) instead of an indicia 30 which protrudes. This is a matter of preference. A reflector or a lenticular lens 33 may be added to the back of the board to light either the holes 40 or the indicia devices 30 which are pushed through the holes 60.

Figure 4C:
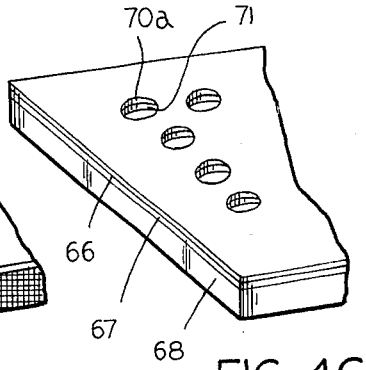

Many existing name plates are often made from a laminate of different colored plastic sheets which are milled in such a manner that the upper laminate of one color is cut through, but the underlying laminate of a second color is not cut. As a result, the laminate appears to have; say white letters on a black background. The same effect can be achieved (FIG. 4B) by punching holes 63 through a laminate 64 of one color (white, for example) and then placing that laminate on a sheet 65 of a different colored plastic. Thus, the mosaic of holes 63 appears as black dots on a field of white. If desired, a plurality of different colored dots may be used (FIG. 4C). Thus, for example, first laminate 66 might be white, second laminate 67 might be blue, and third laminate 68 might be red. Holes 70 and 70A may be formed in the first white laminate 66, while holes 71 are formed in the blue second laminate 67. Then, holes 71 in the blue second laminate 67 are aligned with certain mating holes 70A in the white first laminate 66. There are no holes 71 in the red third laminate 68. The red third laminate is then added at the back of the assembly. The white surface of white laminate 66 now appears to contain a row of blue dots where holes 70 appear and a row of red dots where holes 70A and 71 are in register. That is to say, each dot will appear under a white base with a blue hole and a red background.

Figure 5:
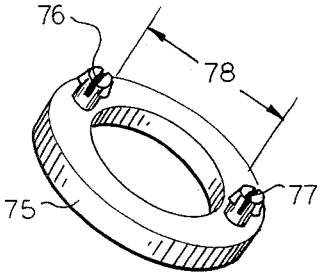
FIG. 5 is a perspective view of the rear of an indicia.
Figure 6:
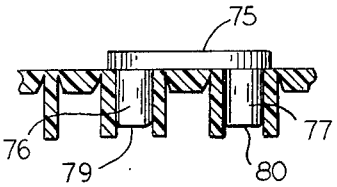
FIG. 6 is a cross-sectional view of the indicia of FIG. 5, when in place on the structure of FIG. 1.

Other indicia 75 may be in any suitable geometrical form, such as the letter O (or numeral zero) of FIG. 5. Here, the indicia 75 has two posts 76, 77 which are separated by a distance 78 equal to the distance between mating holes in the cellular structure 20. Therefore, the posts 76, 77 on indicia 75 may be pushed through holes, such as 79, 80, formed in the surface 22 and extending into the cellular structure 20, as shown in FIG. 6.

Figure 7:
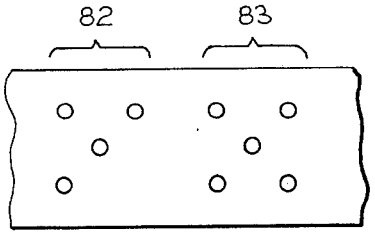
FIG. 7 is a schematic coded plan for insuring the display of proper indicia and for identification purposes.

FIG. 7 illustrates a further refinement wherein every alpha-numerical or other character has posts, such as 76, 77, arranged in a distinctively coded pattern. Thus, for example, the pattern at 82 may be distinctive of the letter F and the pattern at 83 may be distinctive of the letter E. Thus, if a letter is pulled off or lost, it will be impossible to replace it accidentally with an incorrect letter. If a product is so marked with coded holes, and it is lost or stolen, the holes will form an identification for the owner, even if the letters are removed.

Figure 8:
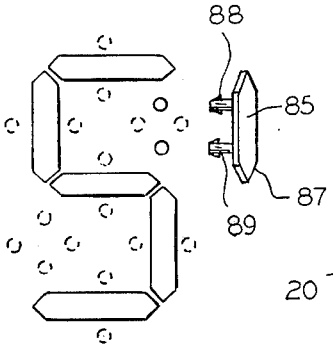
FIG. 8 shows an alternative indicia form which may be assembled for making the mosaic of various numbers and letters.
Figure 9:
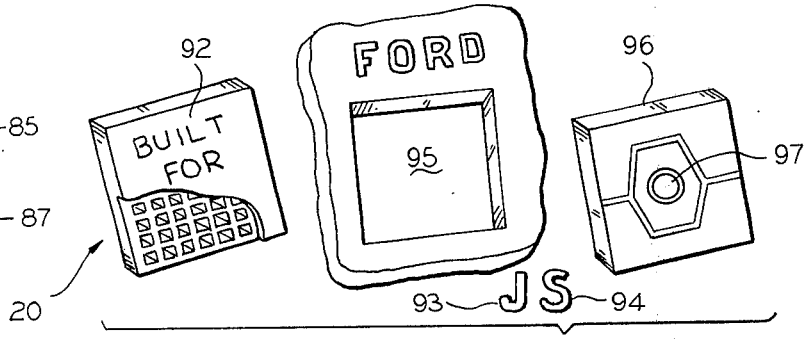
FIG. 9 is a perspective view of the preferred embodiment of FIGS. 1–8, as it may be used to personalize a product.

FIG. 8 illustrates how different style or font letters may create unique effects. Here, the type font is similar to an appearance of light emitting diodes presently used in many computers. The back lighting may be used to enhance the light emitting diode image.

In greater detail, FIG. 8 is here depicted as being made from six identical pieceparts which may be assembled to make a mosaic. Each piecepart comprises an elongated plate 85 having a point 86, 87 at either end. A pair of posts 88, 89 from the plate 85 with a spacing such that they fit snugly into holes 90, 91 formed in the underlying surface 22. It has been found that all letters and numbers can be made from one style of pieceparts or may be formed in a very attractive manner by using six different forms of pieceparts.

The preferred embodiment of FIGS. 1–8 is ideal for signs, nameplates, tags, or any other similar independent structures. It may also be used for distinctively marking a manufactured product. In one form, a tag or board of the embodiment of FIGS. 1–6 might be attached to a product having a panel depressed therein for giving an original equipment look.

Here, by way of example, it is thought that an appropriate indicia might be, "Ford — built especially for J. S.". The object is to give a personalized display with an original manufacture appearance to the product which is not, in fact, of personalized construction. Of course, any other suitable indicia might also be provided. It is assumed that the words, "built especially for" letters 92 might be a single one of many cliches which may be selected and added to the board 20 as a unit. The letters "J. S.", 93, 94 would be selected on a customized basis.

According to this embodiment of the invention, the body of the automobile has a depressed section 95, which is an integral part of the body, and is shaped and dimensioned to receive the board 92. For example, the section 95 could be formed in the center of a steering wheel or a dashboard, a fender panel in front of a door, the hood, or perhaps in a pillar between windows.

In the original construction, the product is manufactured with a standard decorative panel 96 containing a trademark or design 97 fitted into the space 95. The purchaser may thus buy a product having a finished appearance. However, if the buyer wishes to personalize his product he may use the inventive board 20 and mount alpha-numerical or other characters 93–94 of any choice on it in any of the above-described manners. Then he may remove the original panel 96 and substitute it with the personalized panel 20.

Sometimes the purchaser would prefer to have even more of a "built-in" look than he can achieve from use of the adapter panel 20. In this case, the tools and dies which shape a housing, body or panel are modified to make a field 100. Thus, if FIG. 10 represents a section of a dashboard panel 99, a sheet of metal is placed over an embossing die having a number of semi-piercing punches formed thereon then a mating die is brought down over the metal sheet to press it into the shape of a dashboard.

Figure 11:
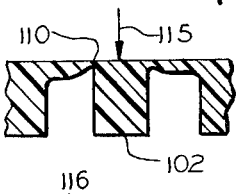
FIG. 11 is a cross-sectional view taken along line 11 of FIG. 10 and showing the cellular structure in the second embodiment.

As this is done, one of the punches forms a weakened armular area 101 on the back of the panel (FIG. 11). Thus, there is a center plug 102 which may be easily knocked out to form a hole. In like manner, an entire field 100 may be formed with a width W and a height H, which cooperate to form many points where a hole may be formed.

Figure 10:
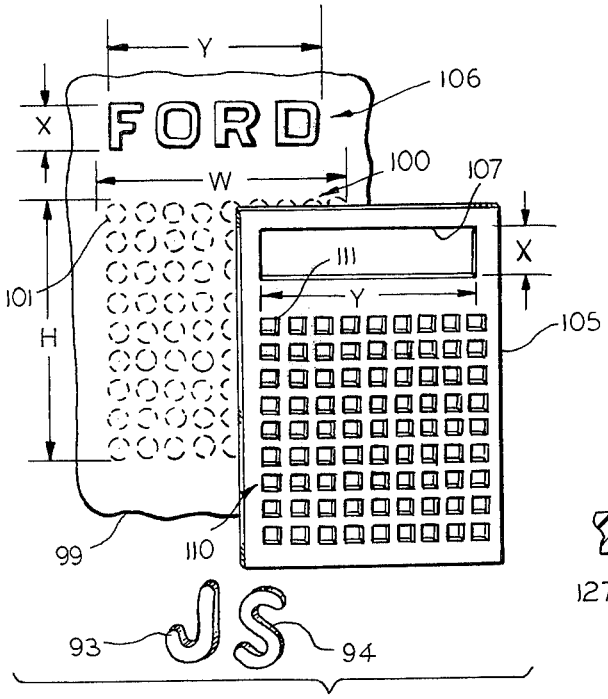
FIG. 10 is a perspective view of a second embodiment wherein the cellular structure is an integral part of the housing of a product.

Since the back of the cellular structure is not visible on the panel of FIG. 10, the surface of field 100 may have spots of paint or print or type which can be easily washed away. The surface formed thereon of field 100 may be punched at such a painted spot, to form a connector point for receiving an indicia. Alternatively, there could be small protrusions in the center of each cell which would locate the cells while being hardly visible.

According to another plan for the embodiment of FIGS. 10–13, a template 105 is placed over a locator, of any suitable form, which is provided by the manufacturer. In the above-cited example, ("Ford—built especially for J. S.") the trademark 106 "Ford" is embossed on the panel to provide a convenient locator. Therefore, a window 107 in template 105 may be fitted snugly over the trademark locator 106 (i.e., the outside dimensions $x$ and $y$ of the locator 106 almost exactly equal the inside dimensions $x$, $y$ of window 107). The template is die cut and the trademark is located by the precision of the body tool and dies of the automobile production line. Thus, the grid work 110 in the template is precisely located over the fragile knock out areas. The grid in the template 105 could either be openings in a plastic or metal plate, for example, or lines printed on a thin sheet of plastic film. The film would tend to keep the finish from being scratched by a punch. Accordingly, the heavily inked template square 111, for example, is over the hole 101. Therefore, it is easy to punch a hole through the surface of the field 100 where it is weakened to form the hole 101, even when the cellular structure is not visible. Thereafter, the indicia may be attached easily by fitting them through the punched holes.

Figure 12A:
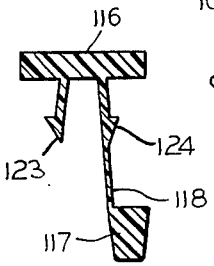
FIG. 12 is a series of schematic views showing how indicia may be attached to the cellular structure of FIGS. 10 and 11.

The rear surface of field 100 is selectively reduced in thickness to form weakened punch out area 102 (FIG. 11) embossed into the back of the metal. If a punch 115 is placed over the center 102 of this area, and tapped, an opening is easily made in the surface. An indicia 116 (FIG. 12) may then be fitted through the punched out opening. This indicia may take form, for example, shown in FIG. 12. For example, FIG. 12A shown a flexible plastic piece part 116 in the form of a split rivet having a wedge 117 integrally joined thereto by a thread of plastic 118. When the split rivet 116 is fitted through a hole 121 in panel 99, the barbs 123, 124 on the ends of the split rivet flair out and capture the back of the panel 99.

Figure 12B:
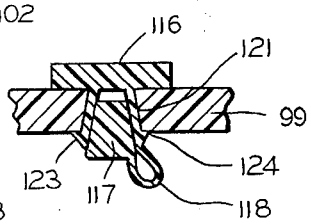

The indicia might rattle and annoy a nearby person. Therefore, the wedge 117 is driven into the split rivet to tighten it and preclude any vibration (FIG. 12B).

Figure 12C:
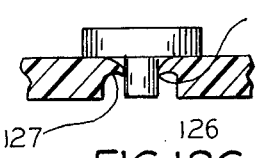
Figure 12D:
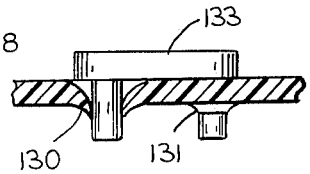
Figure 12E:
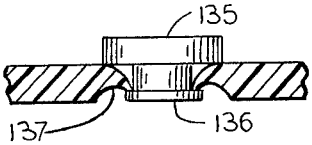

FIG. 12C shows another method of securing indicia in a hole knocked out of the field 102. Here, the indicia 125 has posts 126 which are used as the punch. The thin edges 127, 128 deform inwardly around the punched out area 102 in order to seize and hold the posts 126 of the indicia 125.

When an indicia (FIG. 12C) similar to that of FIGS. 5 or 8 is used, more holes are punched as 130 and 131. Then, the indicia 133 is fitted through the holes where they are held in place by the sharp edges of the deformed metal.

A special device 135 for use on or in connection with a metal panel 99 is somewhat similar to a collar button 135, wherein a dome member 136 deforms the metal at 137 and captures the member 136.

Those who are skilled in the art will readily perceive many alternative uses and modifications of the invention. For example, the panel 20 could be part of a wristwatch face, a toaster or other appliance, a coaster, a calendar, a picture, or the like. The background which could be shown through the holes could be light reflecting or embossed. Fastening protrusions of the indicia might be pushed into the punched out holes. Parts may be tapered or otherwise formed to make a more snug, or locking fit. Thus, the appended claims are to be construed to include all equivalent structures.

I claim:

1. A personalized indicia apparatus comprising:

an integral board means having a cellular structure comprising a plurality of fastening connector halves;

a surface covering said cellular structure and concealing said plurality of fastening connector halves forming said cellular structure, said surface having means to facilitate the punching away of said surface over one or more of said fastening connector halves, said means for facilitating the punching away of said surface comprising a series of geometrically shaped fragile peripheral indentations in said surface, each of said series of said indentations aligned with one of said plurality of fastening connector halves respectively to enable facilitated removal of said surface in said geometric shape, directly over one of said plurality of fastening connector halves;

said indicia means including mating fastening connectors whereby the indicia may be inserted through the punched areas positioned in place in the cellular structure, and means whereby the connectors on the indicia attach themselves to the connector halves in the cellular structure;

said cellular structure comprising horizontal and vertical partitions beneath said surface between each of said series of geometrically shaped indentations, and said connectors completing a seizure responsive to a snug fit between the cellular walls of said fastening connector halves and said connectors, each of said connectors comprising at least one mating rod on said indicia means.

2. The apparatus of claim 1 wherein said indicia is made of light conducting material to reveal the color of any surface backing said board.

* * * * *